US008810220B2

(12) United States Patent
Bai et al.

(10) Patent No.: US 8,810,220 B2
(45) Date of Patent: Aug. 19, 2014

(54) POWER SUPPLY DEVICE, A PROCESSING CHIP FOR A DIGITAL MICROPHONE AND RELATED DIGITAL MICROPHONE

(75) Inventors: Rongrong Bai, Beijing (CN); Jianting Wang, Beijing (CN); Duanduan Jian, Beijing (CN); Wenjing Wang, Beijing (CN); Jing Cao, Rancho Santa Margarita, CA (US)

(73) Assignee: Beijing KT Micro, Ltd., Beijing (CN)

( * ) Notice: Subject to any disclaimer, the term of this patent is extended or adjusted under 35 U.S.C. 154(b) by 306 days.

(21) Appl. No.: 13/249,017

(22) Filed: Sep. 29, 2011

(65) Prior Publication Data

US 2012/0086419 A1 Apr. 12, 2012

(30) Foreign Application Priority Data

Oct. 9, 2010 (CN) ..... 2010 1 0504447

(51) Int. Cl.
*G05F 1/40* (2006.01)
*H04R 1/04* (2006.01)

(52) U.S. Cl.
CPC ..... *H04R 1/04* (2013.01)
USPC ..... 323/280; 323/277

(58) Field of Classification Search
USPC ..... 323/205, 265, 266, 271, 273, 275–277, 323/280, 285–288; 363/20, 21.02, 21.06, 363/60, 65, 68; 327/311, 227, 538, 543
See application file for complete search history.

(56) References Cited

U.S. PATENT DOCUMENTS

| | | | | |
|---|---|---|---|---|
| 5,705,919 | A * | 1/1998 | Wilcox | 323/282 |
| 5,864,227 | A * | 1/1999 | Borden et al. | 323/280 |
| 5,966,004 | A * | 10/1999 | Kadanka | 323/271 |
| 6,201,375 | B1 * | 3/2001 | Larson et al. | 323/277 |
| 6,696,822 | B2 * | 2/2004 | Takabayashi | 323/224 |
| 6,707,280 | B1 * | 3/2004 | Liu et al. | 323/224 |
| 7,571,094 | B2 * | 8/2009 | Goudar | 704/221 |
| 8,278,893 | B2 * | 10/2012 | Motz | 323/273 |
| 2008/0168281 | A1 * | 7/2008 | MacInnes | 713/300 |

FOREIGN PATENT DOCUMENTS

CN 1667536 A 9/2005

OTHER PUBLICATIONS

Chinese First Examination Report of China Application No. 201010504447.4, dated Apr. 3, 2013.

* cited by examiner

*Primary Examiner* — Rajnikant Patel
(74) *Attorney, Agent, or Firm* — J.C. Patents

(57) ABSTRACT

A power supply device, a processing chip for a digital microphone and related digital microphone are described herein. In one aspect, a power supply device includes: at least two cascaded low-dropout linear regulators. In another aspect, a processing chip for digital microphone includes a processing module and a power supply module, wherein the power supply modules includes at least two cascaded low dropout linear regulators. In another aspect, a digital microphone includes a microphone and a processing chip, wherein the processing chip includes a processing module and a power supply module, wherein the power module includes at least two cascaded low-dropout linear regulators. Embodiments described herein provide a power supply device with higher PSRR.

21 Claims, 3 Drawing Sheets

POWER SUPPLY DEVICE, A PROCESSING CHIP FOR A DIGITAL MICROPHONE AND RELATED DIGITAL MICROPHONE

RELATED APPLICATIONS INFORMATION

The application claims priority under 35 U.S.C. 119(a) to Chinese application number 201010504447.4 filed on Oct. 9, 2010, which is incorporated herein by reference in its entirety as if set forth in full.

BACKGROUND

1. Technical Field

The embodiments described herein relate to electronic circuits, and more particularly, to a power supply device, a processing chip for a digital microphone and related digital microphone.

2. Related Art

Digital microphone is an electro-acoustic component of the microphone, which directly outputs a digital pulse signal. Digital microphone has the characteristics of high anti-interference capabilities, high integration, and ease of use, and it is widely used for power and size sensitive portable devices.

FIG. 1 is a schematic diagram showing a digital microphone under the existing technologies. The digital microphone may include a microphone 11 and a processing chip 12. The processing chip 12 may include a power supply module 121 and a processing module 122. In particular, the microphone 11 converts the sound signals into analog electrical signals and outputs the analog signals to the processing chip 12, the processing module 122 in the processing chip 12 amplifies the analog signals and converts the amplified analog signals into digital signals for output. Under the existing technology, the power supply module 121 normally employs a low-dropout linear regulator (LDO). FIG. 2 is a circuit diagram showing the LDO under the existing technologies. The LDO may include a pass device VT, a voltage divider including R1 and R2, and an operational amplifier A. For the LDO, the power supply rejection ratio (PSRR) is an important specification. PSRR may describe the extent that the output signal is being affected by the power supply, the greater the absolute value of the PSRR, the less the output signal is being affected by the power supply.

For the processing chip 12, the higher the PSRR of the power supply module 121, the better the performance of the processing chip is, but when the power supply module 121 employs one LDO, its PSRR is still relatively low and there is no better solution for power supply module with higher PSRR under the existing technologies.

SUMMARY

A power supply device, a processing chip for a digital microphone and related digital microphone are described herein and the described provides a power supply device with higher PSRR.

In one aspect, a power supply device includes: at least two cascaded low-dropout linear regulators connected in series comprising a first low-dropout linear regulator LDO and a second LDO, wherein the type of the pass device for the first LDO is different with the type of the pass device for said second LDO.

In another aspect, a processing chip for digital microphone includes a processing module and a power supply module, wherein the power supply modules includes at least two cascaded low dropout linear regulators connected in series comprising a first low-dropout linear regulator LDO and a second LDO, wherein the type of the pass device for the first LDO is different with the type of the pass device for said second LDO.

In another aspect, a digital microphone includes a microphone and a processing chip, wherein the processing chip includes a processing module and a power supply module, wherein the power module includes at least two cascaded low-dropout linear regulators connected in series comprising a first low-dropout linear regulator LDO and a second LDO, wherein the type of the pass device for the first LDO is different with the type of the pass device for said second LDO.

Because the overall PSRR of the power supply is equal to the sum of the PSRR of each individual LDO, a power supply with higher PSRR is achieved.

These and other features, aspects, and embodiments are described below in the section entitled "Detailed Description."

BRIEF DESCRIPTION OF THE DRAWINGS

Features, aspects, and embodiments are described in conjunction with the attached drawings, in which.

DETAILED DESCRIPTION

Figure 1:
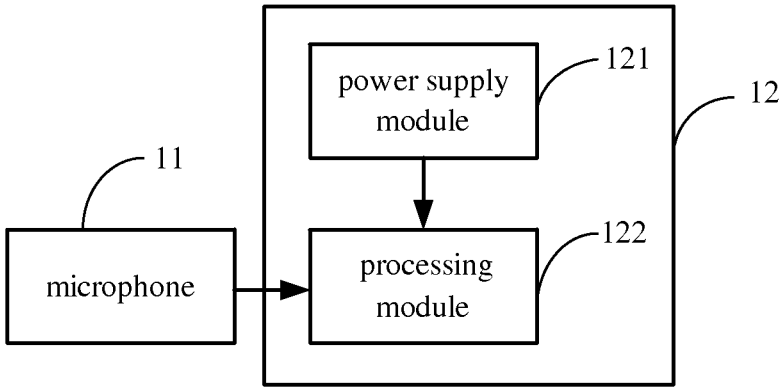
FIG. 1 is a schematic diagram showing a digital microphone under the existing technologies.

Referring now to the drawings, a description will be made herein of embodiments herein.

Figure 2:
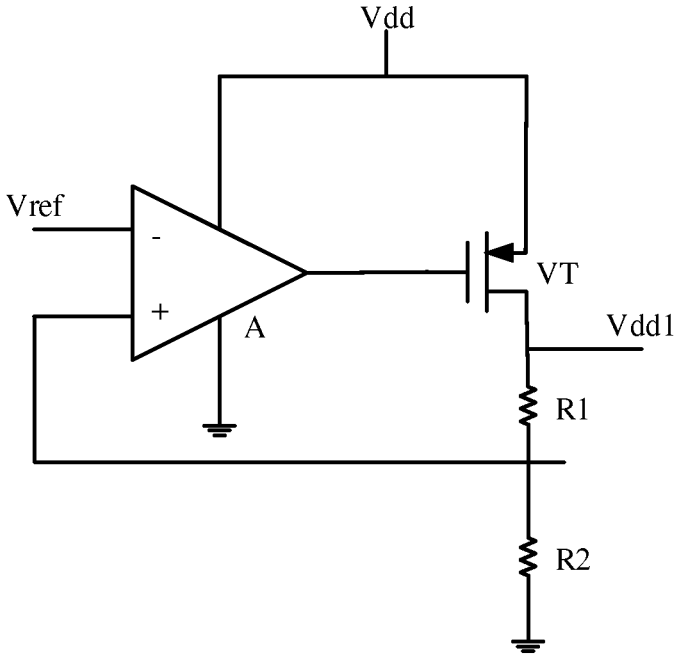
FIG. 2 is a circuit diagram showing an LDO under the existing technologies.
Figure 3:
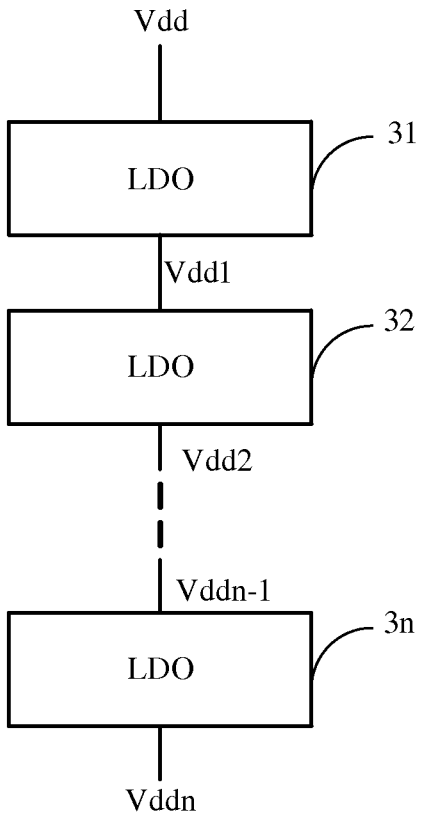
FIG. 3 is a schematic diagram showing a power supply device according to a first embodiment.

The first embodiment of the power supply device:

FIG. 3 is a schematic diagram showing a power supply device according to a first embodiment. The power supply device may include at least two cascaded LDOs 31, 32, . . . 3*n*, in particular, n is a natural number and is greater than or equal to 2. The topology of each LDO is illustrated in FIG. 2.

The PSRR of the power supply device may be calculated based on the following formula:

$$\begin{aligned} PSRR &= 20\log\frac{\Delta V_{ddn}}{\Delta V_{dd}} \\ &= 20\log\frac{\Delta V_{dd1}}{\Delta V_{dd}}\cdot\frac{\Delta V_{dd2}}{\Delta V_{dd1}}\cdot\ldots\cdot\frac{\Delta V_{ddn}}{\Delta V_{ddn-1}} \\ &= 20\log\frac{\Delta V_{dd1}}{\Delta V_{dd}} + 20\log\frac{\Delta V_{dd2}}{\Delta V_{dd1}} + \ldots + 20\log\frac{\Delta V_{ddn}}{\Delta V_{ddn-1}} \\ &= PSRR1 + PSRR2 + \ldots + PSRRn \end{aligned}$$

In particular, PSRR1 is the PSRR of the LDO 31, PSRR2 is the PSRR of the LDO 32, PSRRn is the PSRR of the LDO 3*n*, the PSRR of the power supply device is equal to the sum of PSRR of each individual LDO and hence the power supply device possesses higher PSRR as a result.

The second embodiment of the power supply device:

The difference between this embodiment and previous embodiment is that in this embodiment, n=3. In addition, in this embodiment, the pass device of each LDO may be a PMOS FET or an NMOS FET. When the pass device of the LDO is an NMOS FET, the LDO may further include a voltage pump to overcome the impact of the gate-source voltage VGS, and the voltage pump may be configured to connect between the operational amplifier of the LDO and the power supply of the LDO.

Figure 4:
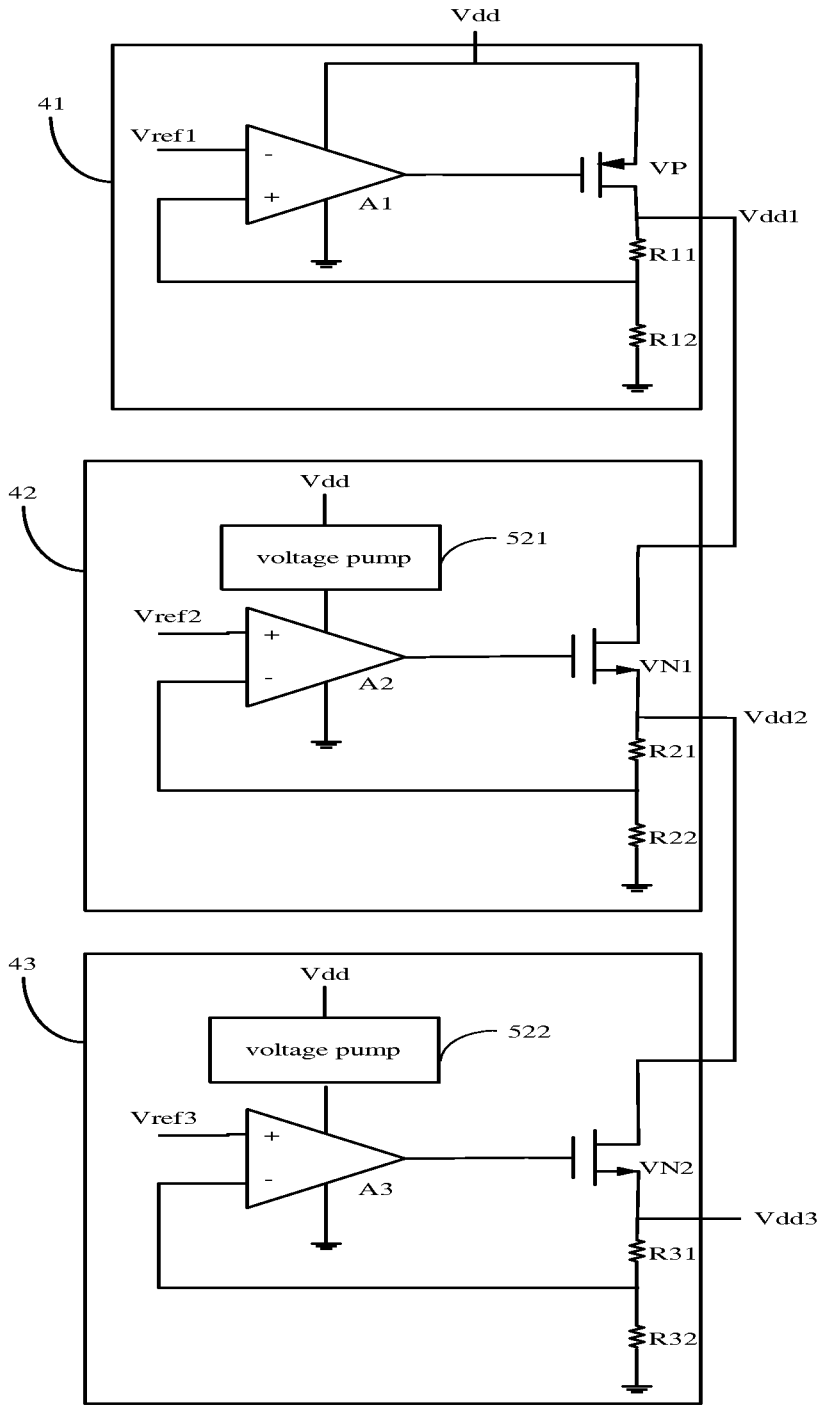
FIG. 4 is a schematic diagram showing a power supply device according to another embodiment.

FIG. 4 is a schematic diagram showing a power supply device according to another embodiment. The three LDOs may include a first LDO 41, a second LDO 42 and a third LDO 43. The second LDO 42 may be configured to connect between the first LDO 41 and the third LDO 43. In particular, the first LDO 41 may include a pass device, an operational amplifier A1, and a voltage divider including R11 and R12, the second LDO 42 may include a pass device, an operational amplifier A2, and a voltage divider including R21 and R22, the third LDO 43 may include a pass device, an operational amplifier A3, and a voltage divider including R31 and R32. In this embodiment, the pass device of the first LDO 41 may be a PMOS FET VP, the pass device of the second LDO 42 may be an NMOS FET VN1, the pass device of the third LDO 43 may be an NMOS FET VN2, the second LDO 42 may also include a voltage pump 521 and the voltage pump 521 may be configured to connect between the operational amplifier A2 and the power supply Vdd, and the third LDO 43 may further include a voltage pump 522 and the voltage pump 522 may be configured to connect between the operational amplifier A3 and the power supply Vdd. The drain of the PMOS FET VP for the first LDO 41 may be configured to connect to the drain of the NMOS FET VN1 for the second LDO 42, the source of the NMOS FET VN1 for the second LDO 42 may be configured to connect to the drain of the NMOS FET VN 2 for the third LDO 43.

The PSRR of the power supply device is equal to the sum of PSRR of the three LDOs, resulting in a power supply device with higher PSRR.

An embodiment for the processing chip:

The schematic diagram for this embodiment is the same as the processing chip 12 illustrated in FIG. 1. In particular, the power supply module 121 may be the aforementioned first embodiment or second embodiment of the power supply device.

An embodiment for the digital microphone:

The schematic diagram for this embodiment is the same as the schematic diagram in FIG. 1. In particular, the power supply module 121 may be the aforementioned first embodiment or second embodiment of the power supply device.

While certain embodiments have been described above, it will be understood that the embodiments described are by way of example only. Accordingly, the systems and methods described herein should not be limited based on the described embodiments. Rather, the systems and methods described herein should only be limited in light of the claims that follow when taken in conjunction with the above description and accompanying drawings.

What is claimed is:

1. A power supply device, comprising: at least two cascaded low-dropout linear regulators connected in series comprising a first low-dropout linear regulator LDO and a second LDO, wherein the type of the pass device for said first LDO is different with the type of the pass device for said second LDO.

2. The power supply device according to claim 1, wherein the power device comprises three cascaded low-dropout linear regulators.

3. The power supply device according to claim 2, wherein the low-dropout linear regulator further comprises a voltage pump connecting the operational amplifier of said low-dropout linear regulator and the power supply of said low-dropout linear regulator.

4. The power supply device according to claim 3, wherein the three low-dropout linear regulators comprises the first LDO, the second LDO, and a third LDO, wherein said second LDO is configured to connect between the first LDO and the third LDO, the pass device of said third LDO is an NMOS FET, and the source of the NMOS FET for the second LDO is configured connect to the drain of the NMOS FET for the third LDO.

5. A processing chip for a digital microphone, comprising: a processing module and a power supply module, wherein the power supply module comprises at least two cascaded low-dropout linear regulators connected in series comprising a first low-dropout linear regulator LDO and a second LDO, wherein the type of the pass device for the first LDO is different with the type of the pass device for said second LDO.

6. The processing chip for a digital microphone according to claim 5, wherein the power supply module comprises three cascaded low-dropout linear regulators.

7. The processing chip for a digital microphone according to claim 6, wherein the low-dropout linear regulator further comprises a voltage pump being configured to connect the operational amplifier of said low-dropout linear regulator and the power supply of said low-dropout linear regulator.

8. The processing chip for a digital microphone according to claim 7, wherein the three low-dropout linear regulators comprises the first LDO, the second LDO, and a third LDO, wherein said second LDO is configured to connect between the first LDO and the third LDO, the pass device of said third LDO is an NMOS FET, and the source of the NMOS FET for the second LDO is configured to connect to the drain of the NMOS FET for the third LDO.

9. A digital microphone, comprising: a microphone and a processing chip, wherein the processing chip comprises a processing module and a power supply module, wherein the power supply module comprises at least two cascaded low-dropout linear regulators connected in series comprising a first low-dropout linear regulator LDO and a second LDO, wherein the type of the pass device for the first LDO is different with the type of the pass device for said second LDO.

10. The digital microphone according to claim 9, wherein the power supply module comprises three cascaded low-dropout linear regulators.

11. The digital microphone according to claim 10, wherein the low-dropout linear regulator further comprises a voltage pump being configured to connect the operational amplifier of said low-dropout linear regulator and the power supply of said low-dropout linear regulator.

12. The digital microphone according to claim 11, wherein the three low-dropout linear regulators comprises the first LDO, the second LDO, and a third LDO, said second LDO is configured to connect between the first LDO and the third LDO, the pass device of said third LDO is an NMOS FET, and the source of the NMOS FET for the second LDO is configured to connect to the drain of the NMOS FET for the third LDO.

13. The power supply device according to claim 1, wherein the pass device of said first LDO is a PMOS FET, the pass device of said second LDO is an NMOS FET, and the drain of the PMOS FET for the first LDO is configured to connect to the drain of the NMOS FET for the second LDO.

14. The power supply device according to claim 1, wherein the low-dropout linear regulator further comprises a voltage pump connecting the operational amplifier of said low-dropout linear regulator and the power supply of said low-dropout linear regulator.

15. The power supply device according to claim 2, wherein the three low-dropout linear regulators comprises the first LDO, the second LDO, and a third LDO, said second LDO is configured to connect between the first LDO and the third LDO, the pass device of said third LDO is an NMOS FET, and the source of the NMOS FET for the second LDO is configured to connect to the drain of the NMOS FET for the third LDO.

16. The processing chip for a digital microphone according to claim 5, wherein the pass device of said first LDO is a PMOS FET, the pass device of said second LDO is an NMOS FET, and the drain of the PMOS FET for the first LDO is configured to connect to the drain of the NMOS FET for the second LDO.

17. The processing chip for a digital microphone according to claim 5, wherein the low-dropout linear regulator further comprises a voltage pump connecting the operational amplifier of said low-dropout linear regulator and the power supply of said low-dropout linear regulator.

18. The processing chip for a digital microphone according to claim 6, wherein the three low-dropout linear regulators comprises the first LDO, the second LDO, and a third LDO, said second LDO is configured to connect between the first LDO and the third LDO, the pass device of said third LDO is an NMOS FET, and the source of the NMOS FET for the second LDO is configured to connect to the drain of the NMOS FET for the third LDO.

19. The digital microphone according to claim 9, wherein the pass device of said first LDO is a PMOS FET, the pass device of said second LDO is an NMOS FET, and the drain of the PMOS FET for the first LDO is configured to connect to the drain of the NMOS FET for the second LDO.

20. The processing chip for a digital microphone according to claim 9, wherein the low-dropout linear regulator further comprises a voltage pump connecting the operational amplifier of said low-dropout linear regulator and the power supply of said low-dropout linear regulator.

21. The processing chip for a digital microphone according to claim 10, wherein the three low-dropout linear regulators comprises the first LDO, the second LDO, and a third LDO, said second LDO is configured to connect between the first LDO and the third LDO, the pass device of said third LDO is an NMOS FET, and the source of the NMOS FET for the second LDO is configured to connect to the drain of the NMOS FET for the third LDO.

* * * * *